US008439588B2

(12) United States Patent
Houman

(10) Patent No.: US 8,439,588 B2
(45) Date of Patent: May 14, 2013

(54) FLUID POWERED BATH ACCESSORY

(76) Inventor: Bruce Houman, Corona, CA (US)

( * ) Notice: Subject to any disclaimer, the term of this patent is extended or adjusted under 35 U.S.C. 154(b) by 0 days.

(21) Appl. No.: 13/414,330

(22) Filed: Mar. 7, 2012

(65) Prior Publication Data

US 2012/0159724 A1 Jun. 28, 2012

Related U.S. Application Data

(62) Division of application No. 12/545,735, filed on Aug. 21, 2009.

(51) Int. Cl.
*A46B 11/06* (2006.01)

(52) U.S. Cl.
USPC ..... 401/289; 15/29; 601/97

(58) Field of Classification Search ..... 401/289; 15/22.2, 29, 32, 33, 37, 50.2, 52.2; 4/601, 4/606; 601/105
See application file for complete search history.

(56) References Cited

U.S. PATENT DOCUMENTS

| | | | | |
|---|---|---|---|---|
| 3,042,949 | A * | 7/1962 | Mosely | 15/21.1 |
| 3,992,744 | A * | 11/1976 | Fassler | 15/22.1 |
| 4,089,079 | A | 5/1978 | Nicholson | |
| 4,228,558 | A | 10/1980 | Zhadanov | |
| 4,458,676 | A * | 7/1984 | Pileggi | 601/105 |
| 4,780,922 | A | 11/1988 | Sanchez | |
| 4,841,590 | A | 6/1989 | Terry et al. | |
| 5,065,463 | A | 11/1991 | Le | |
| 5,129,121 | A | 7/1992 | Gelman | |
| 5,165,132 | A * | 11/1992 | Giorgio et al. | 15/22.2 |
| 6,151,728 | A | 11/2000 | Wright et al. | |
| 6,205,607 | B1 | 3/2001 | Tse | |
| 6,481,040 | B1 * | 11/2002 | McIntyre | 15/21.1 |
| 6,662,386 | B1 * | 12/2003 | Bowerman | 4/606 |
| 7,941,887 | B2 | 5/2011 | Tsai | |
| 2007/0293794 | A1 * | 12/2007 | Siegrest et al. | 601/97 |

FOREIGN PATENT DOCUMENTS

GB 2387773 A 10/2003

* cited by examiner

*Primary Examiner* — Huyen Le
*Assistant Examiner* — Jennifer C Chiang
(74) *Attorney, Agent, or Firm* — Trentice V. Bolar

(57) ABSTRACT

A fluid-powered bath brush that uses the kinetic energy of moving water to operate skin-cleaning attachments. In one embodiment, the bath brush comprises a brush head member having at least one brush head housing, a water wheel, a first drive gear, a second drive gear and a brush element rotatably mounted thereon, an adaptor with an outlet side adapted to be connected to a showerhead and an inlet side adapted to be connected to a first fluid-dispensing means that carries water to the showerhead and contains a diverter which diverts the flow of water from the first fluid-dispensing means to the showerhead to the flow of water from the first fluid-dispensing means to the brush head member and a flexible second fluid-dispensing means containing at least two tubes for carrying water connecting the brush head member and the adaptor.

17 Claims, 6 Drawing Sheets

FLUID POWERED BATH ACCESSORY

BACKGROUND

1. Field

The present disclosure relates generally to bath accessories and more specifically to a fluid-powered bath accessory that allows the showerhead of a typical shower enclosure to continue to operate while the water powered bath accessory is being used.

2. Background

Bath accessories are adapted to be utilized by persons when using a bathtub or shower unit for washing the body. There exists a need for bath accessories that can be used in conjunction with existing bathroom hardware. Additionally, there exists a need to provide a fluid-powered bath accessory that utilizes water pressure from the showerhead in a safe manner. Further, there exists a need to provide a fluid-powered bath accessory that allows the showerhead to continue to operate when the bath accessory is in use. Further still, there exists a need to provide a plurality of drive methods for the bath accessory. Furthermore, there exists a need to provide a bath accessories that is simple and easy to use, economical in cost to manufacture and operates in a rotary or oscillating motion while providing other benefits and advantages mentioned herein.

SUMMARY

A primary object of the present invention is to provide a fluid-powered bath accessory that will overcome the aforementioned shortcomings.

Another object is to provide a fluid-powered bath accessory that utilizes water pressure from a flexible hose assembly connected to a diverter valve at the showerhead, so as to drive a rotating or oscillating accessory in a safe manner.

An additional object is to provide a fluid-powered bath accessory that allows the showerhead of a typical shower enclosure to continue to operate when the bath accessory is in use by having a dual lumen assembly attached such that one lumen delivers water to the bath accessory and the other lumen returns water from the bath accessory to the showerhead.

A still further object is to provide a plurality of drive methods for the bath accessory. Method one is to use magnetic coupling between the interchangeable head element and the internal driven gear to eliminate water that is powering the bath accessory and prevent it from contaminating the interchangeable head element. Method two is a direct drive between the interchangeable head element and the internal driven gear wherein minor amounts of water powering the bath accessory are allowed to escape at the interchangeable head element.

A still further object is to construct the bath accessory such that it can operate the interchangeable head element in a rotating or oscillating motion.

A still further object is to provide a fluid-powered bath accessory in which the interchangeable head element is removable and replaceable so as to allow for the same or other types of body-cleaning devices to be attached.

A further object is to provide a fluid-powered bath accessory that is simple and easy to use.

A still further object is to provide a fluid-powered bath accessory that is economical in cost to manufacture.

In one embodiment of the present disclosure, a fluid-powered bath accessory that provides an oscillating motion is disclosed. The bath accessory comprises a head member having at least one head housing, wherein the head housing has an internal cavity, wherein the internal cavity includes a side and a periphery; a water wheel containing a water wheel pivot hole, wherein the amount of space between the water wheel and the head housing is adapted to provide a reduced clearance area at the sides and periphery of the brush head housing where water first enters the head housing to restrict water flow around the water wheel; a drive plate containing a drive plate pivot hole; a link arm, wherein the link arm is operably connected to the water wheel, via the water wheel pivot hole, and operably connected to the drive plate, via the drive plate pivot hole; an interchangeable head element in meshing engagement with the drive plate; a showerhead adaptor having an externally threaded outlet side and an internally threaded inlet side, that diverts water flow to the head member; a flexible single-structured fluid-dispensing means, wherein the flexible single-structured fluid-dispensing means includes at least two lumen for carrying water, and wherein the flexible single-structured fluid-dispensing means connects the head member and the showerhead adaptor; and wherein the fluid-powered bath accessory is adapted to operate in conjunction with typical showerheads.

In one aspect of at least one embodiment of the present disclosure, the first drive gear of the bath accessory has a diameter that is less than the second drive gear of the bath accessory and the first drive gear is (a) formed on the longitudinal side of the water wheel thereby forming a single unit therewith and (b) in meshing engagement with the second gear.

In another aspect of at least one embodiment of the present disclosure, the amount of space between the water wheel and brush head housing is adapted to provide a reduced clearance area at the sides and periphery of the brush head housing where water first enters the brush head housing to significantly restrict the flow of water around the water wheel.

In an embodiment of the present disclosure, the flexible single-structured fluid-dispensing means is made of plastic or a flexible to semi-flexible material.

In an embodiment of the present disclosure, the second drive gear is in meshing engagement with the interchangeable head element.

In an embodiment of the present disclosure, the showerhead adapter of the bath accessory allows water to flow to both a typical showerhead and the bath accessory at the same time.

In yet another embodiment, the single-structured flexible fluid-dispensing means is connected or bonded together to create a Siamese hose.

In yet another aspect of at least one embodiment of the present disclosure, the flexible single-structured fluid-dispensing means may be a plastic tube within another larger plastic tube.

The bath accessory further may comprise a valve or switch that allows water either to flow to the head member or to bypass the head member and return to the showerhead.

In an embodiment of the present disclosure, the interchangeable head element may include a hex-shaped shaft that is in meshing engagement with the second drive gear.

In an embodiment of the present disclosure, a fluid-powered bath accessory is provided, containing a interchangeable head element that provides an oscillating motion. The bath accessory comprises a head member having at least one head housing, water wheel containing a pivot hole, a link arm, a drive plate containing a drive plate pivot hole and an interchangeable head element rotatably mounted on the head member, a showerhead adaptor with an externally threaded outlet side adapted to be connected to a showerhead and an internally threade inlet side adapted to be connected to a first fluid-dispensing means that carries water to the showerhead and containing a diverter which diverts the flow of water from the first fluid-dispensing means to the showerhead to the flow of water from the first fluid-dispensing means to the head member and a flexible single structured fluid-dispensing means containing at least two lumen for carrying water connecting the head member and the showerhead adaptor.

In an embodiment of the present disclosure, the link arm is operably connected to the water wheel via the water wheel pivot hole and operably connected to the drive plate, via the drive plate pivot hole, which is in meshing engagement with the interchangeable head element.

In an embodiment, the amount of space between the water wheel and head housing is adapted to provide a reduced clearance area at the sides and periphery of the head housing where water first enters the head housing to significantly restrict the flow of water around the water wheel.

In yet another aspect of at least one embodiment of the present disclosure, the water wheel includes cup-shaped portions at the periphery of the water wheel.

In an embodiment, the cup-shaped portions of the water wheel are propelled by the water from the flexible single-structured fluid dispensing means, which causes the interchangeable head element to oscillate.

In an embodiment, a fluid-powered bath accessory that provides an oscillating motion is provided, comprising a head member having at least one head housing, wherein the head housing includes an internal cavity, wherein the internal cavity includes a side and a periphery, wherein the head housing includes a curved or contoured area that allows the bath accessory to be held firmly; a water wheel, wherein the water wheel includes cup-shaped portions at its periphery, and wherein the water wheel includes a water wheel pivot hole, wherein the amount of space between the water wheel and the internal cavity includes a reduced clearance area at the sides and the periphery of the internal cavity where water first enters the head housing, and wherein the reduced clearance area restricts water flow around a portion of the water wheel; a drive plate, wherein the drive plate includes a drive plate pivot hole, wherein the drive plate is able to accept a hex-shaped shaft, and wherein the drive plate is both magnetically coupled to the hex-shaped shaft and in meshing engagement therewith; a link arm, wherein the link arm is operably connected to the water wheel via the water wheel pivot hole and operably connected to the drive plate, via the drive plate pivot hole, which is in meshing engagement with the brush element; an interchangeable head element that includes a hex-shaped shaft, wherein the hex-shaped shaft includes a groove cut into it that holds an O-ring, and wherein the interchangeable head element is rotatably mounted on the drive plate; a showerhead adaptor, wherein the showerhead adaptor includes an externally threaded outlet side and an internally threaded inlet side, and wherein the showerhead adaptor diverts water flow to the head member and allows water to flow to the outlet side and the bath accessory at the same time; a flexible single-structured fluid-dispensing means, wherein the single-structured fluid-dispensing means includes at least two lumen for carrying water, and wherein the flexible single-structured fluid-dispensing means connects the head member and the showerhead adaptor; a valve or switch that allows water to either flow to the head member or to bypass the head member and return to the showerhead adaptor; a plurality of interchangeable head elements that include a brush, a pumice stone, a massaging brush, and a soft brush for facial cleansing; and wherein the fluid-powered bath accessory is adapted to operate in conjunction with typical showerheads.

In yet another embodiment, the reduced clearance of the head housing significantly reduces the amount of space between the water wheel and brush head housing at the sides and periphery of the head housing where water from the flexible single-structured fluid-dispensing means first enters the head housing to significantly restrict the flow of water around the water wheel.

Further objects and benefits can be appreciated by one of ordinary skill having reviewed the present disclosure in combination with the accompanying drawings.

DRAWINGS

The above-mentioned features and objects of the present disclosure will become more apparent with reference to the following description taken in conjunction with the accompanying drawings wherein like reference numerals denote like elements and in which.

DETAILED DESCRIPTION

Figure 1:
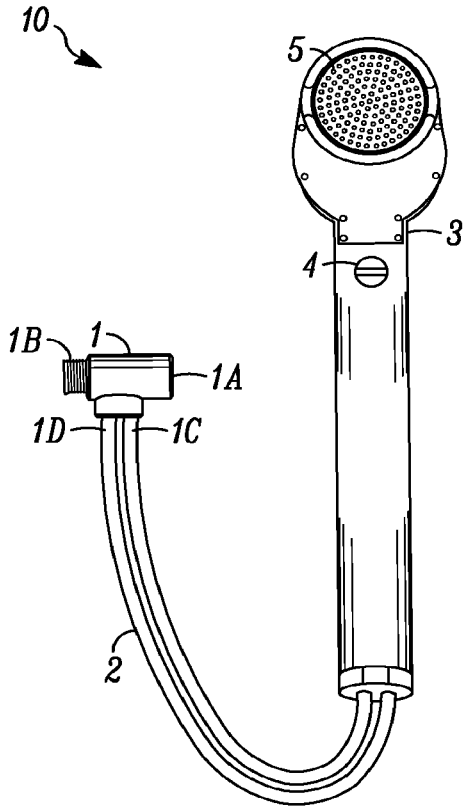
FIG. 1 is an illustration of a top plan view of the bath accessory, in accordance with an embodiment of the present disclosure.
Figure 2:
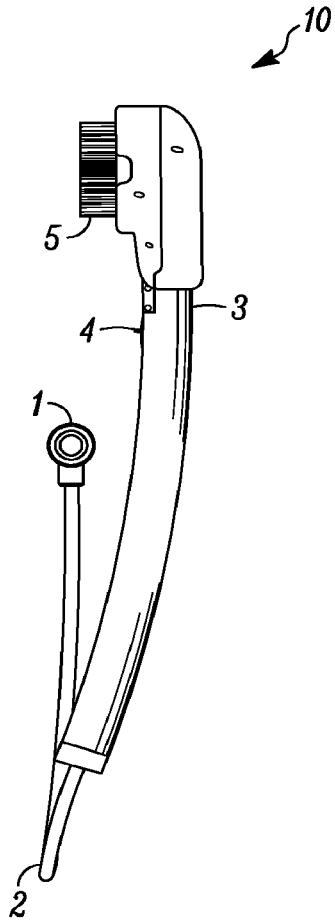
FIG. 2 is an illustration of a side view of the bath accessory, in accordance with an embodiment of the present disclosure.

In an embodiment of the present disclosure, as shown in FIGS. 1 and 2, bath accessory 10 is provided, having showerhead adapter 1 with internally threaded inlet side 1A. Inlet side 1A can typically accept the pipe or other vehicle that carries water (not shown) to which a typical showerhead is typically attached. Externally threaded outlet side 1B is where a typical showerhead can attach, allowing the showerhead and bath accessory 10 to work together seamlessly without the loss of any water.

In an aspect of at least one embodiment of the present disclosure, showerhead adapter 1 blocks off the flow of water to the showerhead and diverts the flow to bath accessory 10. Water to bath accessory 10 leaves showerhead adapter 1 through outlet port 1C. Water from bath accessory 10 returns to inlet port 1D and then to the showerhead.

In an embodiment of the present disclosure, flexible single-structured fluid-dispensing means 2 is a flexible to semi-flexible dual hose to carry water (e.g., plastic tubing) that connects bath accessory 10 and showerhead adapter 1. In another embodiment of the present innovation, flexible single-structured fluid-dispensing means 2 is connected or bonded together to create a multi-lumened Siamese hose. In another embodiment of the present innovation, flexible single-structured fluid-dispensing means 2 can be a tube within another tube.

Bath accessory 10 may contain mechanical components that make the interchangeable head element 5, here a brush, rotate. In another embodiment of the present innovation, the bath accessory also contains on-off valve or switch 4, which controls water flow to bath accessory 10. In the "on" position, water flows to the water wheel mechanism and causes interchangeable head element 5 to rotate, then the water is returned to the showerhead. In the "off" position, the water is allowed to bypass interchangeable head element 5 mechanism and return directly to the showerhead.

Figure 3:
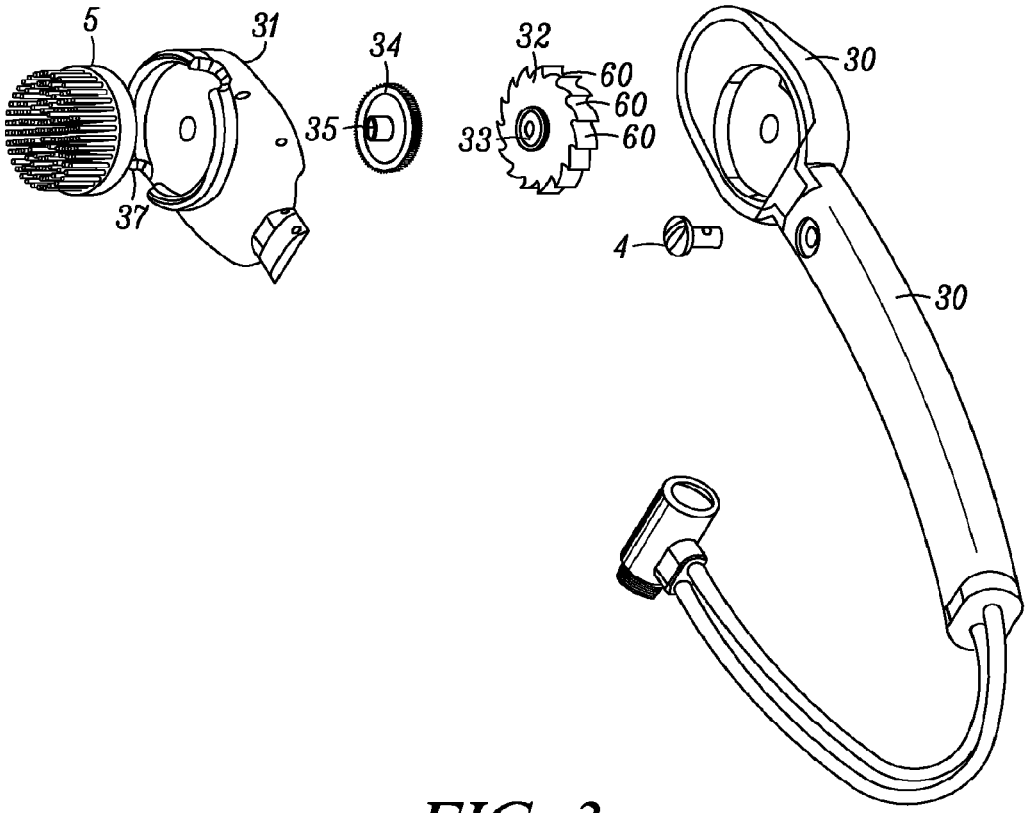
FIG. 3 is an illustration of an exploded perspective view of the bath accessory showing the various component of the head member in relation to each other, in accordance with an embodiment of the present disclosure.
Figure 4:
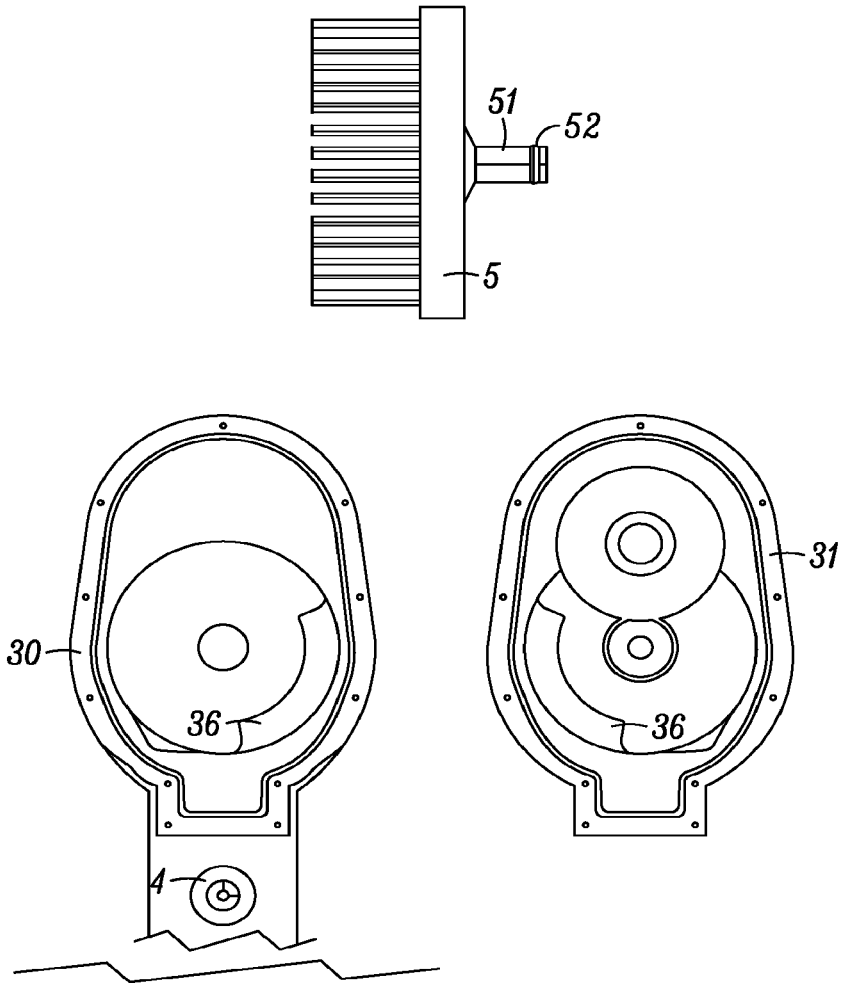
FIG. 4 is an illustration of a top plan view of the head member internal cavity and separate interchangeable head element, in accordance with an embodiment of the present disclosure.

In an embodiment of the present disclosure, the housing of the bath accessory 10 may include curved or contoured area 37 on each side of the accessory to allow a thumb and forefinger to grasp the interchangeable head element and remove it. This allows for the placement of other interchangeable heads such as a stiffer brush, pumice stone abrasive, or other attachments to be used with bath accessory 10. As shown in FIGS. 3 and 4, head housing 30 may contain passages for water to flow to and from the bath accessory, the cavity in which the water wheel 32 and the first drive gear 33 reside, the on-off valve or switch 4 and the attachment area for the upper housing 31.

In an embodiment of the present disclosure, upper housing 31 may contain second driven gear 34 with the pivot shaft broached to include hex shape 35 into which interchangeable head element shaft 51 slides.

FIG. 4 illustrates the internal cavities of head housing 30 and upper housing 31. In an embodiment of the present disclosure, there may be reduced clearance area 36 where the water first enters the bath accessory cavity. In order to achieve a highly efficient and effective water wheel, the clearance area at the sides and periphery must be as tight as possible.

Prior art attempts to achieve this involved making all of the cavity area as tight as possible. Unfortunately, the problem with that approach was that the tolerances required for manufacture made it difficult to impossible to meet for the entire cavity space and required significant time and expense. Additionally, bath accessory 10 material would expand with heat, causing components to rub together, causing unwanted wear and malfunction. Alternatively, the material of the housing would shrink with cold water allowing the mechanism to stop due to too much clearance.

Figure 6:
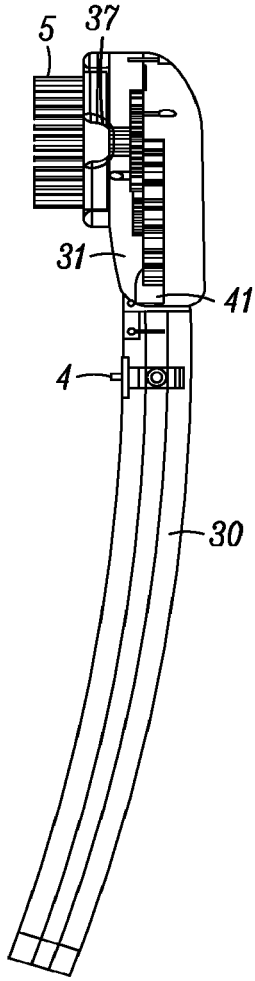
FIG. 6 is an illustration of a side view of the components of the bath accessory in relation to each other, in accordance with an embodiment of the present invention.
Figure 7:
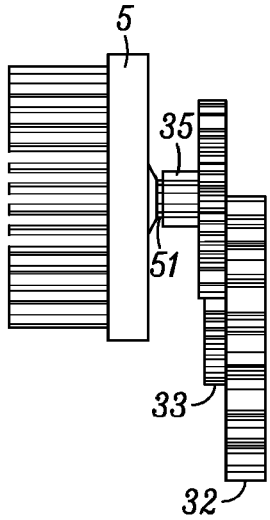
FIG. 7 is an illustration of a side view of the interchangeable head element, first drive gear, water wheel, second drive gear and a portion of the hex-shaped shaft of the interchangeable head element, in accordance with an embodiment of the present invention.

As shown in FIGS. 3, 4, and 6, in an embodiment of the present disclosure, this problem has been mitigated if not eliminated by creating a close tolerance at the entrance area of water into the cavity. Cup-shaped areas 60 on the diameter of water wheel 32 are only effective where the water from nozzle 41 and reduced area 36 contacts cup-shaped areas 60. Once cup-shaped areas 60 have cleared the water inlet area, it no longer provides energy to water wheel 32 and the close tolerance is no longer needed.

In yet another embodiment of the present innovation, interchangeable head element 5 may be connected to second drive gear 34 with hex-shaped shaft 51. Such a connection may allow interchangeable head element 5 to be removed or inserted into second driven gear 35.

As shown in FIG. 4, in an embodiment of the present disclosure, the far end of shaft 51 may have a groove cut into it to hold O-ring 52. Among other things, o-ring 52 may provide additional friction between shaft 51 and second driven gear 34 so interchangeable head element 5 will not fall out.

Figure 5:
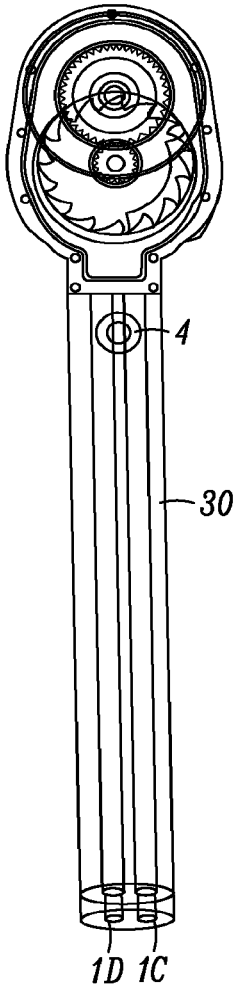
FIG. 5 is an illustration of a top plan view of an embodiment of the bath accessory of the present disclosure showing the components of the bath accessory in relation to each other, in accordance with an embodiment of the present invention.

FIGS. 5 though 7 show an embodiment of the assembled position of the components shown in FIG. 3. Water inlet port 1C of the bath accessory may include, just before it enters the cavity, nozzle 41 that can cause the flow rate of water to increase rapidly. This increased flow impinges on cup-shaped areas 60 of water wheel 32 causing the water wheel to spin.

As shown and demonstrated in FIGS. 1 through 7, in an embodiment of the present disclosure, bath accessory 10 may contain mechanical components that make the interchangeable head element 5 rotate.

Figure 8:
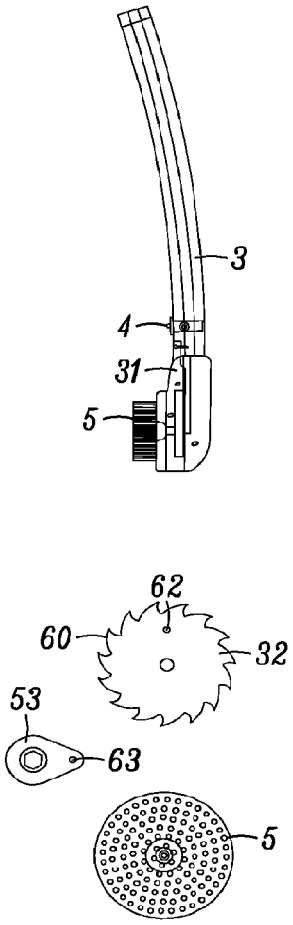
FIG. 8 is an illustration of a side view of the bath accessory showing specific components of the bath brush, in accordance with an embodiment of the present invention.
Figure 9:
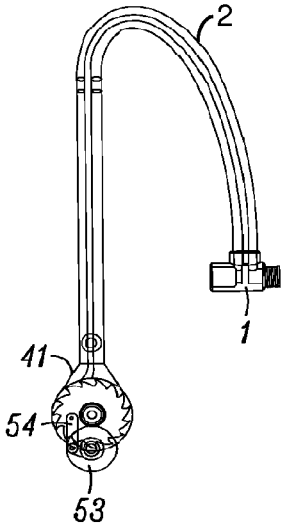
FIG. 9 is an illustration of a top plan view of the bath accessory showing specific internal components of the bath brush, in accordance with an embodiment of the present invention.
Figure 10:
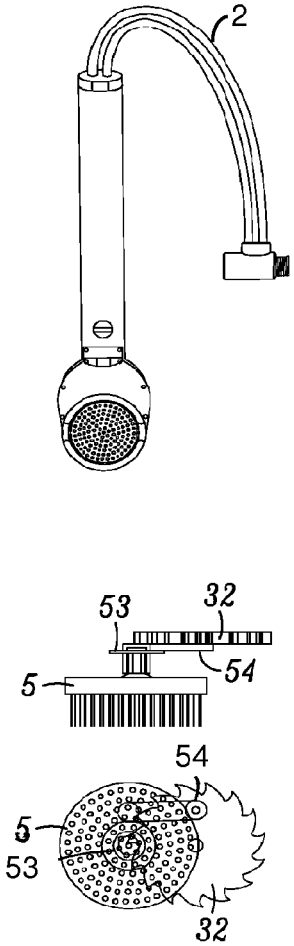
FIG. 10 is an illustration of a top plan view of the bath accessory showing specific components of the bath brush, in accordance with an embodiment of the present invention.
Figure 11:
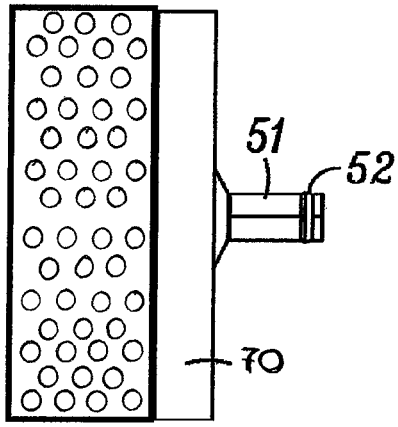
FIG. 11 is an illustration of a side view of the pumice stone interchangeable head element, in accordance with an embodiment of the present invention.

FIGS. 8 through 10 show an embodiment of the present disclosure with the drive components that may provide an oscillating motion to the bath accessory. In an embodiment, water wheel 32 can include water wheel pivot hole 62 into which link arm 54 may be inserted. Further, bath accessory 10 may include drive plate 53 into which an end of link arm 54 may attached via drive plate pivot hole 63. Water wheel 32 may rotate causing a back and forth motion to bath accessory 10. By having interchangeable head element 5 move in a back and forth motion, among other things, it can be used in the hair and scalp area without tangling the user's hair. Showerhead adapter 1 can include internally threaded inlet side 1A for the pipe to which a typical showerhead is normally attached. The externally threaded outlet side 1B is where the typical showerhead attaches. FIG. 11 illustrates a side view of pumice stone interchangeable head 70 that includes hex-shaped shaft 51 and o-ring 52.

It should be appreciated that the present disclosure provides numerous benefits and advantages. For example and not by way of limitation, one of the benefits provided by the bath accessory of the present disclosure is that it can return the water that powered the bath accessory back to the showerhead while still providing other various benefits and advantages discussed herein.

Bath accessories, such as a water-powered bath brush, typically release the water that powered it around the head or out a port. Further, a user has to be careful of where the discharge water is going. Further still, the water discharging around the brush causes whatever bathing agent (e.g., soap or lotion) that is on the brush to be washed off. The water-powered bath accessory disclosed herein provides very little water discharge at the head.

Among other things, the small amount of discharged water acts as a lubricant for the shaft driving the accessory and the bathing agents remain on the accessory.

The bath accessory of the present disclosure can allow the removing and replacing of an interchangeable head element, such as a brush; this also may allow the use of other types of interchangeable heads (e.g., a pumice stone head to remove calluses, a massaging brush and different brushes with various bristle lengths, stiffness, and sizes such as a small soft brush for facial cleaning).

The bath accessories of the present disclosure have various medical benefits and applications. For example and not by way of limitation, the bath accessory could be used by those with mobility problems (e.g., shoulder problems) and those who cannot reach their backs to wash when taking a shower. The present invention can also be used in hospitals, nursing homes and assisted care situations where a staff person needs to help bathe a patient or client. With the bath accessory of the present disclosure, the patient gets cleaner in less time, which is a benefit to both the patient and the staff.

It should be appreciated that the bath accessories of the present disclosure provide the added advantage that no electrical energy is used or wasted as it may run solely on water pressure. Furthermore, in various embodiments of the present disclosure, no water is wasted with the bath accessories of the present disclosure. The water used is cycled back through the showerhead and flows out through it as the user continues to bathe making it an environmentally friendly product that saves money over other bath accessory designs. It is also safe because it can be powered by water thereby eliminating the danger of electrical shock to the user.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A fluid-powered bath accessory that provides an oscillating motion, the accessory comprising:

a) a head member having at least one head housing, wherein the head housing has an internal cavity, wherein the internal cavity includes a side and a periphery;

b) a water wheel containing a water wheel pivot hole, wherein the amount of space between the water wheel and the head housing is adapted to provide a reduced clearance area at the sides and periphery of the brush head housing where water first enters the head housing to restrict water flow around the water wheel;

b) a drive plate containing a drive plate pivot hole, c) a link arm, wherein the link arm is operably connected to the water wheel, via the water wheel pivot hole, and operably connected to the drive plate, via the drive plate pivot hole;

d) an interchangeable head element in meshing engagement with the drive plate;

b) a showerhead adaptor having an externally threaded outlet side and an internally threaded inlet side, that diverts water flow to the head member; and c) a flexible single-structured fluid-dispensing means, wherein the flexible single-structured fluid-dispensing means includes at least two lumen for carrying water, and wherein the flexible single-structured fluid-dispensing means connects the head member and the showerhead adaptor;

wherein the fluid-powered bath accessory is adapted to operate in conjunction with typical showerheads.

2. The bath accessory of claim 1, wherein the head housing has a curved or contoured area to allow a thumb and forefinger to grasp the head element and remove it.

3. The bath accessory of claim 1, wherein the flexible single-structured fluid-dispensing means is made of plastic or a flexible to semi-flexible material.

4. The bath brush of claim 1, wherein the showerhead adapter of the bath accessory allows water to flow to the outlet side and the bath accessory at the same time.

5. The bath accessory of claim 1, wherein the flexible single-structured fluid dispensing means is a multi-lumened hose comprised of at least two lumens.

6. The bath of claim 1, further comprising a valve or switch that allows water either to flow to the head member or to bypass the head member and return to the showerhead adaptor.

7. The bath accessory of claim 1, wherein the interchangeable head element includes a hex-shaped shaft that is in meshing engagement with the drive plate.

8. The bath accessory of claim 1, wherein the water wheel includes cup-shaped portions at the periphery of water wheel.

9. The bath accessory of claim 1, wherein the interchangeable head element includes a hex-shaped shaft magnetically coupled to the drive plate.

10. The bath accessory of claim 1, wherein the interchangeable head element and drive plate are one single structure.

11. The bath accessory of claim 1, wherein the interchangeable head element is a brush element.

12. The bath accessory of claim 1, wherein the interchangeable head element is a pumice stone.

13. The bath accessory of claim 1, wherein the interchangeable head element is a massaging brush.

14. The bath accessory of claim 1, wherein the interchangeable head element is a soft brush for facial cleansing.

15. The bath accessory of claim 1, wherein the accessory further comprises at least two different interchangeable heads elements in the form of a brush with differing bristle lengths, stiffness, and sizes.

16. The bath accessory of claim 1, wherein the second drive gear accepts various types of body-cleaning devices.

17. A fluid-powered bath accessory that provides an oscillating motion, the bath accessory comprising:

a) a head member having at least one head housing, wherein the head housing includes an internal cavity, wherein the internal cavity includes a side and a periphery, wherein the head housing includes a curved or contoured area that allows the bath accessory to be held firmly;

b) a water wheel, wherein the water wheel includes cup-shaped portions at its periphery, and wherein the water wheel includes a water wheel pivot hole, wherein the amount of space between the water wheel and the internal cavity includes a reduced clearance area at the sides and the periphery of the internal cavity where water first enters the head housing, and wherein the reduced clearance area restricts water flow around a portion of the water wheel;

c) a drive plate, wherein the drive plate includes a drive plate pivot hole, wherein the drive plate is able to accept a hex-shaped shaft, and wherein the drive plate is both magnetically coupled to the hex-shaped shaft and in meshing engagement therewith;

d) a link arm, wherein the link arm is operably connected to the water wheel via the water wheel pivot hole and operably connected to the drive plate, via the drive plate pivot hole, which is in meshing engagement with the brush element e) an interchangeable head element that includes a hex-shaped shaft, wherein the hex-shaped shaft includes a groove cut into it that holds an O-ring, and wherein the interchangeable head element is rotatably mounted on the drive plate;

f) a showerhead adaptor, wherein the showerhead adaptor includes an externally threaded outlet side and an internally threaded inlet side, and wherein the showerhead adaptor diverts water flow to the head member and allows water to flow to the outlet side and the bath accessory at the same time; and g) a flexible single-structured fluid-dispensing means, wherein the single-structured fluid-dispensing means includes at least two lumen for carrying water, and wherein the flexible single-structured fluid-dispensing means connects the head member and the showerhead adaptor;

h) a valve or switch that allows water to either flow to the head member or to bypass the head member and return to the showerhead adaptor;

i) a plurality of interchangeable head elements that include a brush, a pumice stone, a massaging brush, and a soft brush for facial cleansing;

wherein the fluid-powered bath accessory is adapted to operate in conjunction with typical showerheads.

* * * * *